US012006805B2

(12) United States Patent
Scott et al.

(10) Patent No.: US 12,006,805 B2
(45) Date of Patent: Jun. 11, 2024

(54) SYSTEM AND METHOD FOR REMOTELY DISCONNECTING A HIGH-PRESSURE PUMP FROM AN ACTIVE FRACTURING OPERATION

(71) Applicant: DMS Solutions, Spring, TX (US)

(72) Inventors: Doug Allen Scott, Spring, TX (US); Guy Alexander Baldwin, Houston, TX (US)

(73) Assignee: DMS Solutions, Spring, TX (US)

( * ) Notice: Subject to any disclaimer, the term of this patent is extended or adjusted under 35 U.S.C. 154(b) by 106 days.

(21) Appl. No.: 17/750,906

(22) Filed: May 23, 2022

(65) Prior Publication Data

US 2022/0372858 A1 Nov. 24, 2022

Related U.S. Application Data

(60) Provisional application No. 63/191,789, filed on May 21, 2021.

(51) Int. Cl.

| | |
|---|---|
| ***E21B 43/26*** | (2006.01) |
| ***F04B 15/02*** | (2006.01) |
| ***F04B 49/06*** | (2006.01) |
| ***F04B 53/10*** | (2006.01) |
| ***F04B 53/22*** | (2006.01) |

(52) U.S. Cl.

CPC ..... *E21B 43/2607* (2020.05); *F04B 15/02* (2013.01); *F04B 49/065* (2013.01); *F04B 53/22* (2013.01); *F04B 53/10* (2013.01)

(58) Field of Classification Search

CPC ..... E21B 43/26; E21B 43/2607; F04B 15/02; F04B 49/065; F04B 53/10; F04B 53/22

See application file for complete search history.

(56) References Cited

U.S. PATENT DOCUMENTS

| | | | | |
|---|---|---|---|---|
| 9,677,391 | B2 * | 6/2017 | Banks | E21B 43/2607 |
| 10,597,991 | B2 * | 3/2020 | Lopez | E21B 43/26 |
| 10,648,243 | B1 | 5/2020 | Burrows | |
| 10,662,740 | B2 | 5/2020 | Cannon et al. | |
| 10,724,682 | B2 | 7/2020 | Beason et al. | |
| 10,900,310 | B2 | 1/2021 | Melton et al. | |
| 11,053,767 | B2 | 7/2021 | Cannon et al. | |
| 11,072,995 | B2 | 7/2021 | Cannon et al. | |
| 11,208,856 | B2 | 12/2021 | Young et al. | |
| 11,242,950 | B2 * | 2/2022 | Johnson | F16L 37/002 |
| 11,396,799 | B2 | 7/2022 | Johnson et al. | |
| 11,401,779 | B2 | 8/2022 | Kuehn et al. | |
| 11,473,399 | B2 | 10/2022 | Beason et al. | |
| 11,480,027 | B2 | 10/2022 | Beason et al. | |
| 11,560,770 | B2 | 1/2023 | Kuehn et al. | |
| 11,591,889 | B2 | 2/2023 | Johnson et al. | |
| 11,655,926 | B2 | 5/2023 | Johnson et al. | |

(Continued)

*Primary Examiner* — Matthew R Buck

(74) *Attorney, Agent, or Firm* — Nolte Lackenbach Siegel

(57) ABSTRACT

A system and method for remotely disconnecting a high-pressure pump from an active fracturing operation that includes a missile side valve in fluid communication with a missile or manifold of a fracturing system, a pump side valve in fluid communication with a moveable high-pressure pump and the missile side valve, and a bleed valve in communication with a fluid passage interconnecting the missile side valve and the pump side valve, wherein the operation of missile side valve, the pump side valve, and the bleed valve are controlled remotely.

15 Claims, 4 Drawing Sheets

(56) References Cited

U.S. PATENT DOCUMENTS

| | | | | |
|---|---|---|---|---|
| 11,781,410 | B2 * | 10/2023 | Post | E21B 43/26 137/615 |
| 2008/0091846 | A1 | 4/2008 | Dang | |
| 2019/0186226 | A1 | 6/2019 | Beason et al. | |
| 2020/0190934 | A1 | 6/2020 | Young et al. | |
| 2020/0355322 | A1 | 11/2020 | Beason et al. | |
| 2020/0386359 | A1 | 12/2020 | Johnson et al. | |
| 2021/0262315 | A1 | 8/2021 | Beason et al. | |
| 2023/0160278 | A1 | 5/2023 | Kuehn et al. | |

* cited by examiner

SYSTEM AND METHOD FOR REMOTELY DISCONNECTING A HIGH-PRESSURE PUMP FROM AN ACTIVE FRACTURING OPERATION

CROSS REFERENCE TO RELATED APPLICATIONS

The present application claims priority to and the benefit of U.S. Prov. Pat. App. Ser. No. 63/191,789, which was filed on May 21, 2021. The aforementioned provisional application is hereby incorporated by reference in its entirety, to the extent that it is consistent with the present disclosure.

BACKGROUND

This background section is intended to provide a discussion of related aspects of the technology space that could be helpful to understanding various embodiments discussed in this disclosure. The information presented in this background section is not intended be an admission of what is or is not prior art, and accordingly, this background section should be considered in that light.

In general, hydraulic fracturing or "fracking" allows companies to produce oil and natural gas from wells that may have traditionally been thought of as non-producing sites. The fracking process involves injecting high pressure water deep into the ground to crack the rock in the production zone of the well, which allows oil or natural gas to flow through the cracks where it previously was not able to. On average, a fracking process takes about three to five days to complete at a wellsite, and once completed, the wellsite is ready to produce oil and natural gas for years to come.

From a technical standpoint, fracking typically involves injection of 3-5 million gallons of water that contains sand and additives at high pressure down and across into horizontally drilled wells as far as 10,000 feet below the surface. The pressurized water/sand/additive mixture causes the rock layers to open up what are called micro-fissures. These fissures are held open by the sand particles from the water that remain in the fissures and this allows the oil and gas to escape the rock and flow up the well bore.

In 2021, fracking was used in approximately 95 percent of oil and gas wells in the United States, and nearly two-thirds of U.S. natural gas production came from fracking, up from just 1% in 2000. In Texas, fracking has enabled oil and gas producers to reach large oil and natural gas reserves trapped in previously unreachable shale formations. In the Permian Basin, which spans across Texas and Southeast New Mexico, fracking caused this area to become one of the most productive shale basins in the world. As such, fracking wells and well sites are critical to energy production in the United States.

FIG. 1 illustrates an exemplary fracking equipment configuration. The exemplary fracking system 100 includes a plurality of fracking pump trucks 102 configured to receive fluids and input and pressurize those fluids for discharge at an output. The pump trucks 102 receive fluids from a blender 104 that is typically in fluid communication with a plurality of fluid and particle sources. For example, the blender 104 may be in communication with a chemical supply truck or tank 120, a plurality of water supply trucks or tanks 112, and acid supply truck or tank 110, and a sand or other particle supply truck or tank 108. The specific sand or particles used to keep the downhole fractures open may be conveyed from the tank 108 to the blender 104 by a conveyor 106. Each of the pump trucks 102 are in fluid communication with a manifold, pressure header, or missile 114 through a plurality of high-pressure connections 118. The manifold or missile 114 communicates the high-pressure fluids and particles to the wellbore 116.

In this typical system 100, fracking pump truck 102 maintenance or repairs are conducted at the end of the working stage since conducting repairs or maintenance in the red zone (the zone near the trucks 102 and missile 114) is prohibited for safety concerns given the high pressures involved in the fracking operation. This presents challenges for fracking operations, as one pump truck failure has the potential to shut down the entire operation since repairs are not allowed while the system is under pressure (operating). Upon a pump failure, some systems may be configured to continue using a reduced pump power or pressure, but this is at a substantial efficiency loss. Further, transition times from well to well are prolonged by pulling trucks offline for repair while the trucks are rigged up to the missile. Additional cost is also an issue for this configuration, as head count must be increased to handle the repair and maintenance workload during non-operating times since multiple pump repairs may be necessary at the same time, as typically time is short between operational pressure runs. Further still, NPT data shows the fracturing pumps are the source of 33% of lost time operations, the largest single cause of lost time, above all other common causes including blender failures, missile malfunctions, data or computer system failures, and sand equipment problems. Therefore, the inability to repair frac pump trucks online coupled with desire to never stop pumping operations often leads to an operating model where pumps are run to failure.

Therefore, there is a need for a fracking pump system and method that provides for maintenance or repair of pump systems with the fracking system under operational pressure. More particularly, there is a need for a fracking pump system that allows for removal and replacement of a fracking pump truck with the fracking system under normal operating conditions (high pressure).

SUMMARY

Embodiments of the disclosure may provide an exemplary device and process to enable disconnection and/or connection of an individual frac pump while the fracturing system as a whole continues to be under pressure and operating, which enables continuous pumping and substantially increases operational efficiency of the fracturing system.

Embodiments of the disclosure may further provide an exemplary system and method for remotely disconnecting a high-pressure pump from an active fracturing operation that includes a missile side valve in fluid communication with a missile or manifold of a fracturing system, a pump side valve in fluid communication with a moveable high-pressure pump and the missile side valve, and a bleed valve in communication with a fluid passage interconnecting the missile side valve and the pump side valve, wherein the operation of missile side valve, the pump side valve, and the bleed valve are controlled remotely.

Embodiments of the disclosure may further provide an exemplary method for disconnecting a fracking pump truck from an active/under pressure fracking system and a method for reconnecting a replacement fracking pump truck to the system. The method for disconnecting a high-pressure fracking pump truck from an active fracking operation that remains under pressure during the disconnect process may include closing, in response to a remotely generated control signal, a missile-side valve in fluid communication with a missile of the fracking operation, the missile side valve being in fluid communication with the high-pressure fracking pump truck, and closing, in response to a remotely generated control signal, a truck-side valve in fluid communication with a high-pressure supply of the high-pressure fracking pump truck and the missile side valve though a fluid conduit. The method may further include opening, in response to a remotely generated control signal, a bleed valve in fluid communication with the fluid conduit, opening the bleed valve operating to vent the fluid conduit to atmospheric pressure, and disconnecting, in response to a remotely generated control signal, a pump side valve connector mounted at a specific height on a rear facing portion of the high-pressure fracking truck, the disconnection severing the fluid communication between the high-pressure fracking pump truck and the fluid conduit.

Embodiments of the disclosure may further provide a system for remotely disconnecting a high-pressure pump from an active fracturing operation that is operating at high-pressure, the system may include a missile side remotely actuated valve in fluid communication with a missile or manifold of a fracturing system, a pump side remotely actuated valve mounted to a moveable high-pressure pump truck and in fluid communication with a high-pressure pump thereon, and a remotely controlled bleed valve in communication with a fluid passage interconnecting the missile side valve and the pump side valve with the high-pressure pump truck is connected to the fracturing system. The system may further include a remotely controlled pump side valve connector mounted at a specific height on the rear facing portion of the moveable high-pressure pump truck, the specific height being equal to a height of a corresponding fixed position connector positioned near and in fluid communication with the missile or manifold, the remotely controlled pump side valve connector being configured to selectively connect to and disconnect from the corresponding fixed position connector by remote control.

BRIEF DESCRIPTION OF DRAWING

The present disclosure is best understood from the following detailed description when read with the accompanying Figures. So that the manner in which the above recited features of the present invention can be understood in detail, a more particular description of the invention, briefly summarized above, may be had by reference to embodiments thereof, some of which are illustrated in the appended drawings. It is to be noted, however, that the appended drawings illustrate only exemplary embodiments of this invention and are therefore not to be considered limiting of its scope, for the invention may admit to other equally effective embodiments not expressly shown in the following Figures.

DETAILED DESCRIPTION

In the following disclosure reference is made to various embodiments of the disclosure. However, it should be understood that the invention is not limited to the described embodiments. Rather, any combination of the features and elements described in the following embodiments, whether related to different embodiments or not, is contemplated within the scope of the invention. Furthermore, in various embodiments the disclosure provides numerous advantages over the prior art, and although embodiments of the disclosure may achieve advantages over other possible solutions and/or over the prior art, whether or not a particular advantage is achieved by a given embodiment is not limiting of the disclosure. Thus, the following aspects, features, embodiments, and advantages are illustrative and are not considered elements or limitations of the appended claims except where recited in a claim. Likewise, any reference to "the invention" in the background or detailed description shall not be construed as a generalization of any inventive subject matter, as the scope of the invention is wholly defined by the appended claims.

Figure 1:
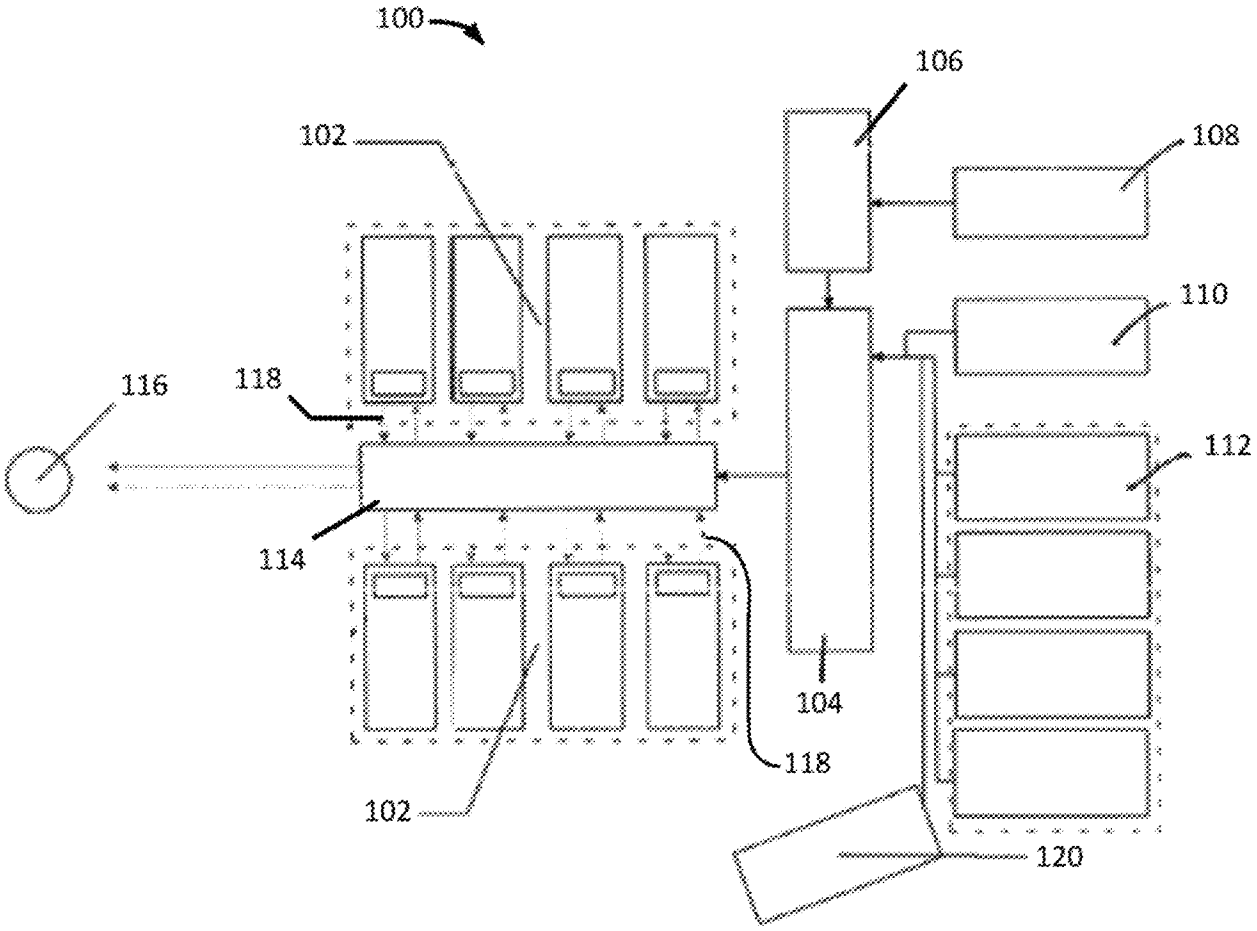
FIG. 1 illustrates an exemplary fracking equipment configuration.
Figure 2:
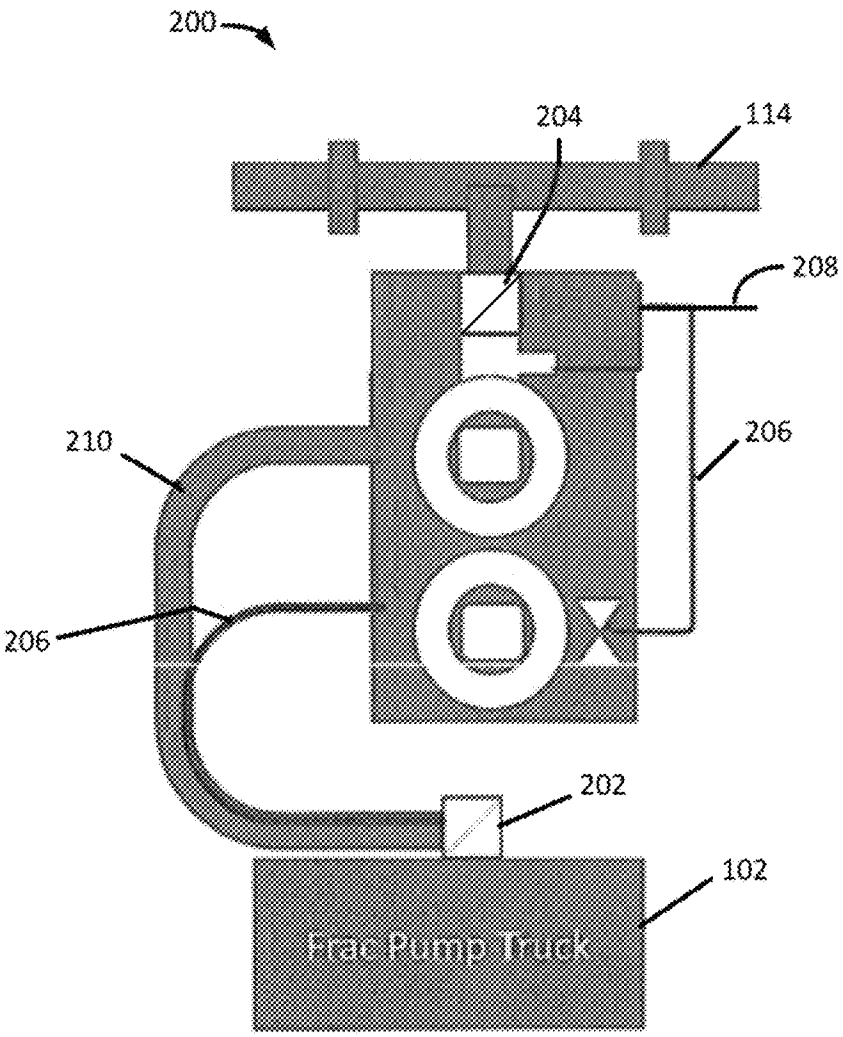
FIG. 2 illustrates an exemplary fracking equipment configuration of an exemplary embodiment of the disclosure.

FIG. 2 illustrates a fracking equipment configuration of an exemplary embodiment of the disclosure. The fracking system 200 includes the fracking pump truck(s) 102 connected to the missile 114 through at least two selectively actuated valves 202, 204. The pump side selectively actuated valve 202 is in fluid communication with the high-pressure output of the fracking pump truck 102. The pump side selectively actuated valve 202 is also in communication with a conduit 210 that communicates the high-pressure fluid and particulate matter (sand and proppants) used in the fracking operation that is pressurized by the fracking pump truck 102 through the conduit 210 to the missile 114, however, there is a second selectively actuated valve 204 that is on the missile side that the high-pressure fluid and particulate matter generated by the fracking pump truck 102 must flow through before that fluid and particulate matter is able to pass into the missile 114. The second selectively actuated valve 204 is in fluid communication with the missile 114 and the high-pressure fluid and particulate supplied by the fracking pump truck 102 via the conduit 210. Additionally, the pump side selectively actuated valve 202 also includes a bleed conduit 206 attached thereto. The bleed conduit 206 is in communication with the high-pressure fluid and particulate stream that is passing through the pump side selectively actuated valve 202 into the conduit 210. The bleed conduit connects to a tank line 208 that is in fluid communication with a tank configured to receive and store bleed fluids at an appropriate pressure. The bleed conduit 206 may also be in communication with the missile side selectively actuated valve 204 on the pump truck side of the valve (not the high pressure missile side of the valve). The storage tank may be used to contain fluids bled from the fracking system 200, and further, the storage tank may be used to supply fluid to the fracking system 202 initialize, start, or otherwise prime the system for operation.

Figure 3:
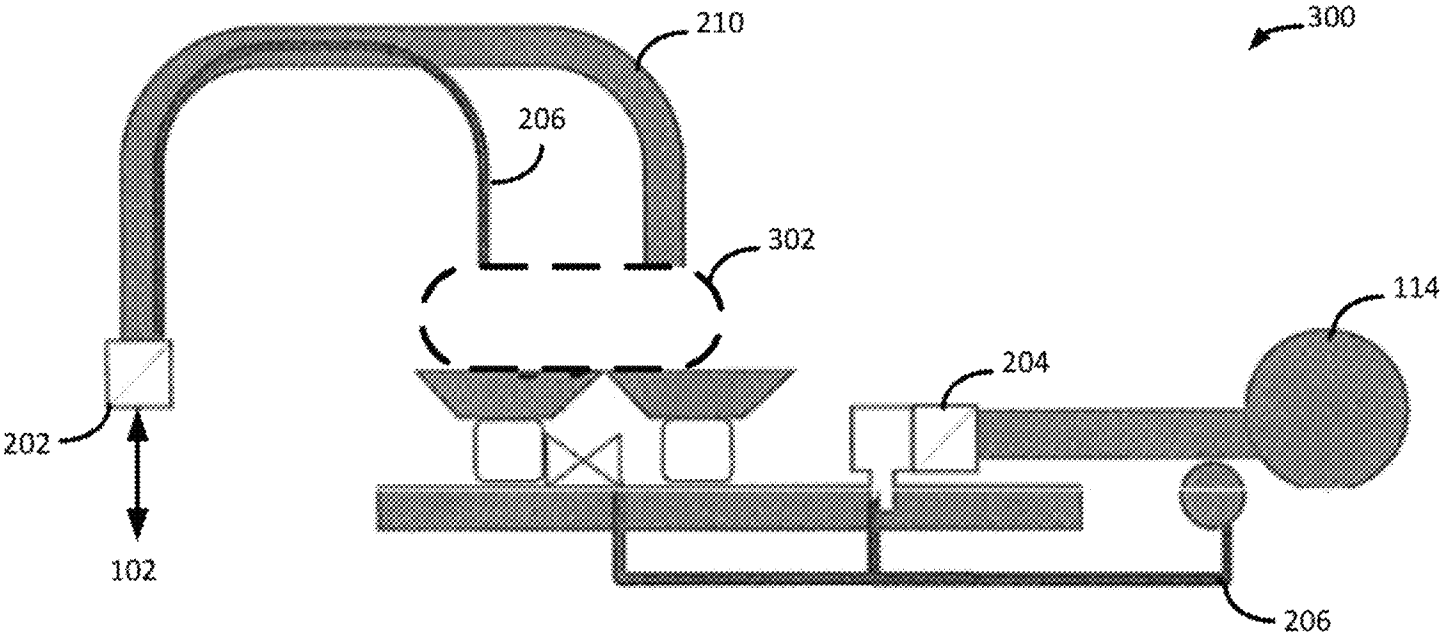
FIG. 3 illustrates an exemplary fracking equipment configuration of an exemplary embodiment of the disclosure.

FIG. 3 illustrates a fracking equipment configuration of an exemplary embodiment of the disclosure. The fracking system 300 includes the fracking pump truck(s) 102 connected to the missile 114 through at least two selectively actuated valves 202, 204. The pump side selectively actuated valve 202 is in fluid communication with the high-pressure output of the fracking pump truck 102. The pump side selectively actuated valve 202 is also in communication with a conduit 210 that communicates the high-pressure fluid and particulate matter used in the fracking operation that is pressurized by the fracking pump truck 102 through the conduit 210 to the missile 114.

A fluid connection location 302 is positioned between the truck side selectively actuated valve 202 and the missile side selectively actuated valve 204. The fluid connection location 302 may generally include a remotely operated or actuated stabbing guide configuration with a hot swap connection. This allows for the fluid conduit 210 to be connected to or disconnected from the fracking system 300 without requiring any manpower to enter the red zone of the fracking operation. Generally speaking, the connection or disconnection process would include first closing both of the selectively actuated valves 204, 202. This isolates the missile 114 from the pump truck 102, however, closing the valves traps existing fluid pressure in the conduit between the selectively actuated valves 202, 204. Therefore, before disconnection of the pump truck, the pressure in the system between valves 202, 204 must be released. This is accomplished by opening the bleed valve in communication with the bleed line 206, which allows the fluid pressure in the system (in the conduit 210 between the respective valves) to pass through the bleed line 206 into the storage tank, and therefore reducing the pressure of the system to essentially atmospheric pressure.

Once the conduit 210 reaches a suitable pressure, which is typically near atmospheric pressure, then the fluid connection location 302 may be actuated to disconnect the high-pressure fluid supply coming from the pump truck 102 (which is typically not operational during this process) to the fracking system. This disconnection essentially allows the fracking pump truck 102 to be removable from the system, meaning the truck may be physically driven out of its working position to a remote location for repair or maintenance as the fluid connections are terminated or disconnected.

The process of pressure isolating the inventive system using the selectively actuated valves 202, 204 allows for movement of the pump truck 102 without personnel ever entering into the red zone (the area behind the pump truck and near the missile where all the high pressure operations are taking place). Further, movement of the pump truck 102 is accomplished without having to shut down the entire fracking system, in that the remaining pump trucks 102 may continue to supply pressurized fluid to the missile 114 and continue fracking operations. As discussed above, current systems do not allow for a pump truck 102 to be removed from the fracking site during operation (while the system is under pressure), as personnel would be required to enter the red zone to disconnect the fluid connections between the pump truck and the missile. The current disclosures automated process for the pressurizing and disconnecting the pump truck allows for continued operation of the entire fracking system well a single pump truck unit 102 is removed for maintenance.

A replacement pump truck 102 may be positioned and connected to the fracking system to replace the pump truck 102 to going into maintenance or repair. The replacement process would generally include positioning the pump truck 102 such that the fluid connection location 302 mounted to the pump truck 102, which may be a stabbing guide type connection, may be connected and secured back to the fracking system. This would involve, for example, backing the truck into a position where the stabbing guide connections on the pump truck 102 are mated together and secured to the fracking system 300 via corresponding connection devices mounted near the fracking system. Once the secure connection is made, the system 300 may be filled or primed from the storage tank via frac pump or another priming source. Then the pump truck may be started and brought up the pressure, the pump side selectively actuated valve 202 may be opened, thus providing pressure to the system 300. Then the missile side selectively actuated valve 204 may be opened, thus providing fluid pressure to the missile from the replaced fracking pump truck 102. This entire process may be again conducted without personnel entering into the red zone.

These selectively actuated valves 202, 204 may be remotely controlled. For example, valves 202, 204 may be electrically driven valves that are in wired communication with a control unit that may be positioned out of the red zone on the fracking site, such as in the control room for the fracking operation. The valves 202, 204 may also be battery operated valves, and may be remotely controlled through a wireless control signal that again may be generated from a control location that is outside the red zone. The valves may be gate valves, ball valves, globe valves, plug valves, butterfly valves, slam shut valves, and any other type of valve used in high pressure fluid control situations. More particularly, the valves may be any type of gas valve device used to regulate the flow of fluids or gases where opening or closing an aperture controls the amount of liquids and gases allowed through the valve. The valve controls the flow of fluids by stopping and starting, adjusting the amounts, controlling the direction, regulating pressure, or relieving pressure.

Similarly, the fluid connection location 302 may also include actuated connection mechanisms that are configured to be remotely controlled. For example, if a stabbing guide type connector is used to connect the replacement fracking truck 102 to the system 300, then as the fracking truck is moved into position and the stabbing guide connection is engaged, a remote actuator may be activated to secure or lock the fluid connection location 302 into position. When a frack pump truck 102 is to be removed, then the remotely actuated connection mechanism may be activated to disengage or unlock the fluid connection 302 to allow the frack pump truck 102 to pull away from the system 300.

Embodiments of the disclosure may provide a system, for example system 200 or 300, whereby individual frack pump trucks 102 may be configured to have the selectively actuated valve 102 mounted thereon. The valve 102 may be physically secured at a specific height or position on the back of the frack pump truck 102. Similarly, the receiving portion of the fluid connection 302 on the system 200, 300 side may be positioned on a generally rigid mounting structure near the fracking system 200, 300 at a specific height or position that corresponds with the height or position of the selectively actuated valve 102 mounted on the back of the frack pump truck 102. This allows for the truck 102 to position near the system 200, 300 and engage the fluid connection 302 to bring the frack truck into fluid communication the system 200, 300 by simply backing the truck into position to mate or engage the connections. The connection may be electronically actuated to secure or lock the connection 302 in place. Thereafter the system 200, 300 may be primed and brought online at operating pressure (high pressure) through the sequential opening of the selectively actuated valves 202, 204 as described herein.

The above noted hot swap-type connection of the fracking pump truck has numerous advantages, including disconnecting under pressure, which is critical to realizing the next step in fracturing operation efficiency and the evolution of continuous fracturing pumping operations regardless of individual pump failures or maintenance requirements. The hot swap process also decreases transition times as pump failures can be repaired and serviced while the frac spread itself continues operating. Hot swap connections allow the operator to bring more pumping capacity online or take pumping capacity offline as needed and without shutting down the entire fracking spread of equipment. Hot swap allows personnel to be more level loaded and reduced on site as the "rush" between stages to transition with minimal NPT is reduced. Hot swap allows the connection to be controlled remotely needing no personnel to enter the red zone to operate the system, including the removal of a pump truck while full pressure fracturing operations continue. The decrease in critical path repairs will lead to more pump hours executed per day increasing revenue for each frac spread.

Figure 4:
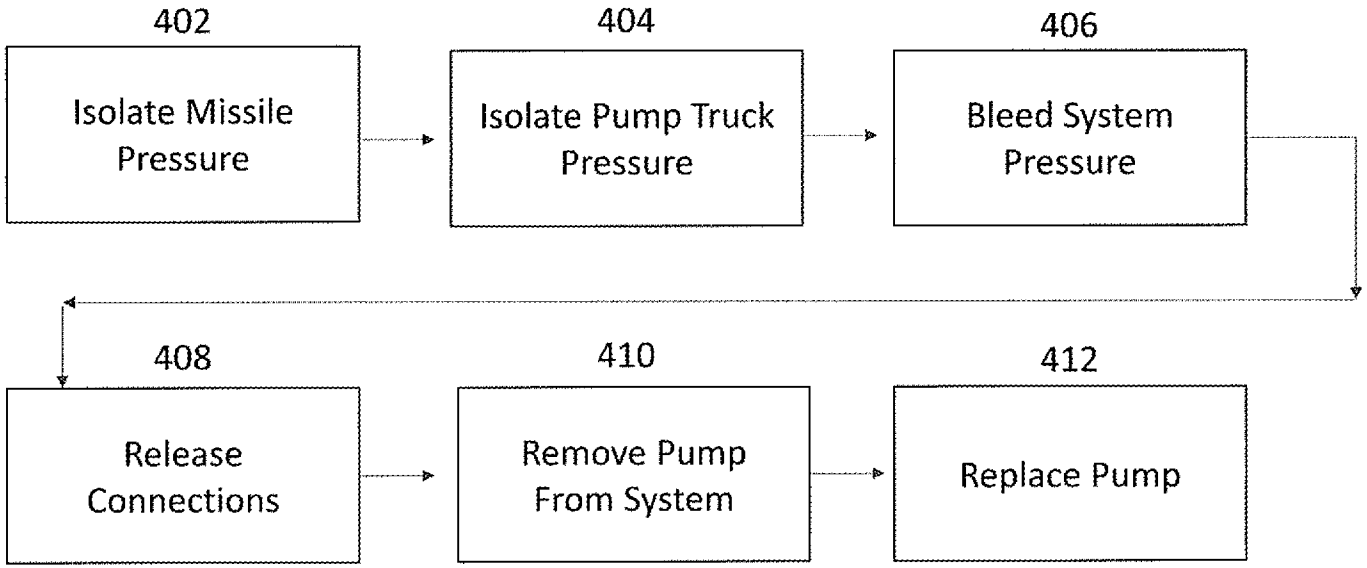
FIG. 4 illustrates a flowchart of an exemplary process of disconnecting a pump truck from a fracking operation according to an embodiment of the disclosure.

Returning to the discussion of the connection and disconnection of a pump truck from a fracking spread, while the pump truck is rigged up to the missile, the header, and the pump barrels, if a disconnection is started the first thing that is accomplished is the pressure at the missile or header is isolated from the system 200, 300 (the valves and the fracking pump truck). The isolation process includes closing a selectively actuated valve connecting the missile or header to the system 200, 300 and the frack pump truck. The closing of this valve closest to the missile prevents the system from backflowing into the pump truck. The valve may be pneumatic, electronic, hydraulic, or any other type of remotely actuated valve used in high pressure operations. Closing the missile side selectively actuated valve isolates the pressure on the missile header side so that high pressure from the system (the other pump trucks connected to the missile or header) is no longer able to flow into the system connected to the pump truck being disconnected. This initial valve closure is represented as 402 in the method flowchart of FIG. 4.

Once the overall system pressure (from the other trucks) is isolated from the pump truck being removed from the spread, the next operation is to isolate the pump truck being removed from the system. This is accomplished by closing the selectively actuated valve on the pump truck side, as represented by 404 in the method flowchart of FIG. 4. The pump truck side selectively actuated valve may be similar to the missile side valve in that it may be any type of remotely actuated valve configured for high pressure operations.

Once both the missile side valve and the pump truck side valve have been closed, then the system of the present disclosure is isolated from receiving pressurized fluids from either side, i.e., the system will no longer receive pressurized fluids from the pump truck or pressurized fluids from the missile or header that are supplied by the remaining pump trucks in the frac spread that are still operational. However, the system of the present disclosure that is positioned between the two selectively actuated valves, e.g., the pump side valve in the missile side valve, may still be at high pressure. Therefore, the pressure in the system is released via a bleed valve in communication with a bleed line that connects to a storage tank. The remaining fluid and particulate matter present in the system between the two selectively actuated valves that may be at high pressure is removed from the system and transported to the storage tank, which in turn reduces the system pressure between the two selectively actuated valves to essentially atmospheric pressure. This bleed process ensures that the subsequent pump disconnection can be accomplished without a high-pressure release of fluid. The bleed valve may be any type of valve used in high pressure operations, such as a needle valve, ball valve, autoclave valve, or any other type of high-pressure valve. The pressure bleed process is represented by 406 in FIG. 4.

Once the system pressure has been substantially relieved through the bleed process, then the process of physically disconnecting the frack pump truck from the system spread may begin. Disconnecting the truck from the still pressurized missile or manifold includes releasing the connections between the pump truck and the system of the present disclosure, for example system 200 or 300. This may be through a pneumatic, hydraulic, electric, or mechanical type of mechanism that can disengage a fluid connection. This may be accomplished by using a male-female type system, where a set of retainer dogs or slips would be used to hold the connection in place until actuated. Once the connection is remotely actuated, then the connection can be separated, such as when the pump truck begins to move away from the fracking spread by driving. The process of releasing the connections is represented by 408 in FIG. 4

The process of physically separating the connections generally involves removing the pump truck from the system, where removing the truck includes physically driving the truck away from the system to separate the connection mechanisms. This driving will separate the connection and allow the truck to move away freely where the pump truck can then be repaired or maintenance outside of the red zone. The process of separating the connection mechanism is generally represented at 410 in FIG. 4.

Once the pump truck has pulled away, a second pump truck may replace the removed pump truck in the same pump truck position as the removed pump truck. The reconnection of the second or replacement truck would entail positioning or backing the second pump truck up to the missile or the header to a position where, for example, a stabbing guide on the truck side of the connection may be used to help guide it into position for connecting to a fixed receiving connector mounted on the fracking system. Once the truck is in position and the connection surfaces are engaged, then the connection may be secured together by the pneumatic, hydraulic, electric, or mechanical type of mechanism that can engage the fluid connection and secure it for high pressure operation. Once the connection engages, it may then engage a set of slips or dogs to retain or hold it in place and a collar or sleeve may be used over the dogs as a safety mechanism to prevent the connection from disengaging under pressure (a safety mechanism). As noted above, the position of the connection on the pump truck may be strategically placed at a specific vertical height so as to mate up with the connection mechanism on the missile or header that it is to be secured to through, for example, the stabbing mechanism and the securing mechanism. The process of replacing the pump truck that was pulled away with a new and operational pump truck is generally represented by 412 in FIG. 4.

Once connected, the system may pressure test the connection to ensure the integrity and no leaks. This may be done by supplying pressure to the internal portion of the system (between the missile side selectively actuated valve and the pump side selectively actuated valve) to confirm pressure integrity of the system. A pressure sensor positioned in the system may be used to monitor the pressure over time to determine if any leaks are present. The pressure supplied to test the integrity of the system may be through a fluid or a gas. For example, the pressure test may be conducted with nitrogen. In an exemplary embodiment of the disclosure the pressure test may be conducted with water or the fracturing fluid without sand or other proppants.

Once the pressure test is completed, then the system may be equalized for operation, which can be done multiple ways. One of the ways could be with a small hydraulic pump in communication with the system that can be used to increase the pressure in the system to the pressure of the missile so as to equalize the pressures between the respective devices. Another way could be to open the missile side selectively actuated valve to allow the pressure in the missile to fill the system to equalize the system. Once the pressure is equalized, then the pump could be reengaged and put back into service by bringing the pump up to pressure and opening the pump side selectively actuated valve, which opens the fluid communication path from the pump through to the missile. Again, each of these valves are remotely actuated along with the functionality of the pump and the securing mechanism.

The sizing of the connections and valves may range, for example, from about 2 inch diameter connections to about 7 inch diameter connections. The pressure rating of these components would typically be about 10,000 PSI to about 22,500 PSI. The connections will typically have metal to metal seals along with an elastomer as this combination has proven suitable for the high pressures and ability to handle sand and other proppants associated with fracking. The metal operates as a first stage seal (metal on meal seal) and the elastomer operates as the second stage seal (elastomer on metal) as this configuration prevents the sand and proppants from eroding the elastomer seal and causing seal failures.

In an exemplary embodiment of the disclosure, a fracking site may contain a plurality of pump trucks. For example, a typical fracturing site may have 6 to 12 pump trucks. In this type of a configuration each of the pump trucks may be configured to include the remotely actuated valve on a rear portion of the truck at a position configured to engage a connection point on the missile or manifold associated with the fracking truck pump location. Therefore, essentially each pump truck can be configured to include the valve and connection mechanism of the present disclosure. Therefore, embodiments of the disclosure provide an apparatus and methodology for independently connecting and disconnecting pump trucks from a fracking site operation, wherein the connecting and disconnecting process may occur without disturbing normal fracking operations, i.e., with the fracking system under normal operating pressure.

An important aspect of the present disclosure is that each of the valves and connection mechanisms are remotely controlled to provide the functionality described herein without requiring any manpower to enter the red zone of the fracking site. As such, each of the operations discussed herein may be completed with the fracking site under normal operation, i.e., at high pressure, as all of the connections and valve operations can be remotely controlled and operated and do not require manpower to enter the red zone. The control function may be managed from the fracking site control room by remote control devices in wired or wireless communication with the systems of the present disclosure (such as on-site or in the fracking truck cab), or remotely from a third location through a wired or wireless network configuration.

A key to the present disclosure is the automation of the connections, as currently the industry does not provide any sort of automated connection or valving mechanisms that allow for removal of a pump truck from the fracking system while it's operational. A typical operation requires the workers to wait until the pressure's bled off, then they go in with a hammer and knock loose a hammer union that connects the pump truck to the pipe that connects to the missile and then pull the truck forward. So it has to be done when there's no pressure on the lines, because you're putting people in the red zone. This system is an automated system to block and bleed off the pressure prior to disconnecting. Then it automates the disconnect, so a person does not have to go into the pressurized area, the red zone, and you do not have to wait until the pressure's blend all. This is an automated system to where you can do real-time pump-automated system to where you can do real time pump removal during the frack.

The system may include the ability to be remotely controlled. Specifically, the system may include the ability receive signals from pressure or position sensors located near the missile side valve, the pump side valve, and the bleed valve at a control station positioned remotely and generating control signals for the missile side valve, the pump side valve, and the bleed valve to control operation thereof. The signals from the sensors may be received in the control truck and processed by microprocessor computer configured to receive the signals, process the signals in accordance with a predetermined software package or algorithm, generate outputs that may be used to display the status of the system and to generate control signals to be sent to the system components to control the operation thereof.

The system may include safety options, such as the connection would not allow you, with pressure, to bleed into the disconnect, so that the electronic transducer that is facing the pressure that you've bled off, would also have an override to where, relay-wise, it would not allow the connection to disengage, open and pull ahead, unless the valve was shut and the pressure was zero. The bleed-off portion, once both valves are isolated and it's time to bleed off, the bleed-off would be done remotely by actuating a needle valve or a ball valve in between the two isolated valves to bleed the pressure off. They system could bleed the pressure off locally, bleed it off to a tank, but the bleed-off method would be monitored by electronic transmitter. For example, the process would be, once you open the bleed-off and the pressure bleeds down to zero, then it would engage the relay to allow the rest of the connection to be disengaged to allow removal or disconnect of a connection.

When reengaging, the re-engagement would be simple to where limit switches may be used for safety. When the stabbing guide is re-engaged to bring the two connections together, the system would latch it, clamp it, and put it back together, but not until the limit switches were properly engaged indicating that the system components (connections) are properly secured or in the proper position for securing. When those clamps and mechanisms are back together, the limits, which would then know that it's back together and the safety function is in place, whether that's a sliding sleeve or a clamp, it would trigger that limit switch. Then it would allow you to pressure test. Once you pressure test the connection, it would then allow you to open the valve to allow fluid pressure into the system for operation.

The system may be configured to not disengage until there is essentially zero pressure in the system after the bleed process (meaning the pressure inside the system after bleeding the pressure is approximately the same and the pressure outside the system, or atmospheric pressure). A key to the bleed process is to ensure that the valves are holding pressure from bleeding back into the connection to the system. So the system of the present disclosure keeps the valves closed to isolate the system, bleed the pressure and the pressure would have to remain bled, zeroed, and not show a positive flow, to be able to continue with the disconnect process. These pressures may be monitored electronically and used to approve or allow the next step in the process as a safety mechanism.

Embodiments of the disclosure generally provide a system for enabling the isolation, disconnection, and reconnection of fluid delivery as part of a larger, fluid delivery system. The system may include an assembly which receives fluid from a one or more fluid sources and directs fluid through the assembly to one or more fluid outlet targets downstream of the system. These fluid inlets and outlets can be flexible, rigid, or other connection interfaces. The system may be a remotely controlled, automated or manual system to enable the disconnection of the assembly from the inlet fluid stream. The system may have the functionality to isolate pressurized fluid in a fluid delivery system by closing a series of valves. These valves could be ball, gate, or other type. The actuation of these valves could be accomplished with pneumatic, electronic, hydraulic, or other. The pressure rating of the system would be about 10,000 psi, 15,000 psi, 22,500 psi or higher. The system of may have the functionality to isolate pressure in a fluid delivery system, bleed off pressure, and indicate to the user that pressure is at zero. The bleed off functionality could be accomplished using a needle valve, autoclave valve, ball valve, pressure containing valve, or other. Bled off pressure can be directed through the system assembly to one or more target locations. The system may include an embodiment wherein the assembly will fluidly seal the connection between the inlet fluid sources and outlet fluid streams. This seal could be metal-to-metal, elastomer, or other. The system may have a connection sub-assembly which connects one or more fluid inlets to the assembly. The connection/disconnection process can be accomplished by pneumatic, hydraulic, electronic, or other means. The sizing of the connection would range from 2 in, 3 in, 4 in, 7 in, or other. The connection type could be oyster style, pin/hoop locking, or other. The reconnection would be enabled by use of a stabbing guide and pneumatic, hydraulic, electronic, or other engagement. A latching mechanism using slips, dogs, sleeves, or other means could be used to maintain connection with pressurized fluid. The system may enable inlet fluid streams to reconnect to other connected, pressurized outlet fluid streams. The system would equalize pressure between the newly connected fluid inlet and pressurized, larger outlet system. This equalization would be accomplished by utilizing the bleed off system, external pump, or other means. The system would execute a pressure test to ensure integrity of the sealed assembly and fluid connection.

While the foregoing is directed to embodiments of the present invention, other and further embodiments of the invention may be devised without departing from the basic scope thereof, and the scope thereof is determined by the claims that follow.

What is claimed is:

1. A system for remotely disconnecting a high-pressure pump from an active fracturing operation, comprising:

a missile side valve in fluid communication with a missile or manifold of a fracturing system;

a pump side valve in fluid communication with a moveable high-pressure pump and the missile side valve; and a bleed valve in communication with a fluid passage interconnecting the missile side valve and the pump side valve, wherein:

the operation of the missile side valve, the pump side valve, and the bleed valve are controlled remotely, the missile side valve, the pump side valve, and the bleed valve comprise remotely actuated check valves, and the pump side valve is mounted on a moveable fracking pump truck.

2. The system of claim 1, further comprising a pump side valve connector mounted at a specific height on a rear facing portion of the moveable fracking pump truck, the specific height being equal to a height of a corresponding fixed position connector positioned near and in fluid communication with the missile or manifold.

3. The system of claim 2, wherein the pump side valve connector and the corresponding fixed position connector comprise a stab in-type connection.

4. The system of claim 3, wherein operation of the missile side valve, the pump side valve, and the bleed valve are remotely controlled by a microprocessor-based computer system or a handheld remote panel.

5. The system of claim 4, wherein the remote control comprises receiving signals from pressure or position sensors located near the missile side valve, the pump side valve, and the bleed valve at a control station positioned remotely and generating control signals for the missile side valve, the pump side valve, and the bleed valve to control operation thereof.

6. The system of claim 5, wherein the bleed valve is in fluid communication with a storage tank configured to receive and store fracking fluids bled from the system through the bleed valve.

7. The system of claim 6, wherein the bleed valve or other fill valve is in fluid communication with a source of fluid/gas pressure to pressurize the system to test the missile side valve and the pump side valve for pressure integrity.

8. A system for remotely disconnecting a high-pressure pump from an active fracturing operation that is operating at high-pressure, comprising:

a missile side remotely actuated valve in fluid communication with a missile or manifold of a fracturing system;

a pump side remotely actuated valve mounted to a moveable high-pressure pump truck and in fluid communication with a high-pressure pump thereon;

a remotely controlled bleed valve in communication with a fluid passage interconnecting the missile side valve and the pump side valve with the high-pressure pump truck is connected to the fracturing system; and a remotely controlled pump side valve connector mounted at a specific height on a rear facing portion of the moveable high-pressure pump truck, the specific height being equal to a height of a corresponding fixed position connector positioned near and in fluid communication with the missile or manifold, the remotely controlled pump side valve connector being configured to selectively connect to and disconnect from the corresponding fixed position connector by remote control.

9. The system of claim 8, wherein the remote control comprises receiving signals from pressure or position sensors located near the missile side valve, the pump side valve, and the bleed valve at a remotely positioned control station and generating control signals for the missile side valve, the pump side valve, and the bleed valve to control operation thereof in accordance with user inputs or a predetermined software process or algorithm.

10. The system of claim 9, wherein the bleed valve is in fluid communication with a storage tank configured to receive and store fracking fluids bled from the system through the bleed valve.

11. The system of claim 10, wherein the bleed valve is in fluid communication with a source of fluid/gas pressure to pressurize the system to test the missile side valve and the pump side valve for pressure integrity.

12. A method for disconnecting a high-pressure fracking pump truck from an active fracking operation that remains under pressure during the disconnect process, comprising:

closing, in response to a remotely generated control signal, a missile-side valve in fluid communication with a missile or manifold of the fracking operation, the missile side valve being in fluid communication with the high-pressure fracking pump truck;

closing, in response to a remotely generated control signal, a truck-side valve in fluid communication with a high-pressure supply of the high-pressure fracking pump truck and the missile side valve though a fluid conduit;

opening, in response to a remotely generated control signal, a bleed valve in fluid communication with the fluid conduit, opening the bleed valve operating to vent the fluid conduit to atmospheric pressure;

disconnecting, in response to a remotely generated control signal, a pump side valve connector mounted at a specific height on a rear facing portion of the high-pressure fracking truck, the disconnection severing the fluid communication between the high-pressure fracking pump truck and the fluid conduit;

moving the high-pressure fracking pump truck away from the active fracking operation once the disconnecting is complete;

replacing the high-pressure fracking pump truck that was moved away from the active fracking operation with another high-pressure pump truck having the same pump side valve connector mounted on a rear portion thereof that is configured to secure to the fixed position fluid connector; and testing pressure integrity of the high-pressure pump truck connected to the missile before pressurizing and going online by pumping a gas into the fluid conduit and monitoring for pressure loss indicative of a leak.

13. The method of claim 12, wherein the pump side valve connector is mounted on the high-pressure fracking truck at a vertical position that is substantially equal to a vertical position of a corresponding fixed position fluid connector positioned near and in fluid communication with the missile or manifold, the corresponding fixed position fluid connector being configured to receive and secure to the pump side valve connector.

14. The method of claim 12, wherein the closing, opening, and disconnecting operations are conducted while the missile is at operational pressure.

15. The method of claim 14, wherein the missile-side valve and the truck-side valve comprise remotely actuated valves.

* * * * *